United States Patent [19]

de Boer

[11] 3,983,705

[45] Oct. 5, 1976

[54] APPARATUS FOR FORMING A BOTTOM PROTECTION

[75] Inventor: Jan de Boer, Waddinxveen, Netherlands

[73] Assignee: Zinkcon, Maatschappij tot uitvoering van moderne zinkconstructies B.V., Werkendam, Netherlands

[22] Filed: Mar. 12, 1975

[21] Appl. No.: 557,556

[30] Foreign Application Priority Data

Mar. 15, 1974 Netherlands ..... 7403530

[52] U.S. Cl. ..... 61/102; 61/1 R; 61/38

[51] Int. Cl.[2] ..... E02D 29/00

[58] Field of Search ..... 61/46.5, 46, 38, 1, 61/5.2, 50, 21

[56] References Cited

UNITED STATES PATENTS

| | | | |
|---|---|---|---|
| 2,390,403 | 12/1945 | van der Rest | 61/38 |
| 2,589,153 | 3/1952 | Smith | 61/46.5 |
| 2,870,609 | 1/1959 | Siebenhausen, Jr. et al. | 61/46.5 |
| 3,529,427 | 9/1970 | Titman | 61/46 |

*Primary Examiner*—Jacob Shapiro
*Attorney, Agent, or Firm*—David Fink

[57] ABSTRACT

Method of forming a bottom protection by means of sunk mattresses around a structure to be lowered in a body of water, wherein the mattresses, attached to the part of the structure to be placed on the bottom, are lowered therewith and are laid out thereon when the bottom is reached. The mattresses, each wound around a roll and with their free end attached adjacent to the lowest part of the structure, are lowered, and on arrival on the bottom the rolls are unrolled radially from the structure base.

2 Claims, 3 Drawing Figures

APPARATUS FOR FORMING A BOTTOM PROTECTION

The present invention relates to a method of forming a bottom protection by means of sunk mattresses around a structure to be lowered in a body of water.

Such a structure may be a drilling platform, but also for example an oil or gas production platform or a storage reservoir for recovered products.

Though not limited thereto, the present invention will be described as applied to a platform to be placed on the sea-bottom, which platform can rest on the sea-bottom with a base in the form of a concrete trough usually composed of cells.

When such structures are lowered it has appeared to be important that a bottom protection is formed around the base of the structure as soon as said base rests on the bottom, as washout starts from that moment. In case of little water depths the bottom protection could be formed by material to be dumped from the water surface. With greater depths, for example in the order of 100–120 m, it has been found that in this way no reliable protection can be realized. Therefore, one has to depend on so-called sunk mattresses, that is, generally rectangular pieces of cloth or similar material, with weighting material attached thereto.

The object of the present invention is to provide a method with which it is possible to position such mattresses accurately with respect to the structure in question on the bottom of the body of water.

In accordance with the invention the method described above is characterized in that the mattresses, attached to the part of the structure to be positioned on the bottom, are lowered therewith and are laid out thereon when the bottom is reached.

Therefore in the method according to the invention the structure to be protected lowers the mattresses, so that in lowering these mattresses it is not necessary to reckon with currents which especially with greater depths form an important factor.

In an elaboration of the invention the mattresses, which are each wound around a roll and with their free end attached adjacent to the lowest part of the structure, can be lowered and on arrival on the bottom the rolls can be unrolled radially from the structure base. Thus it is ensured that the mattresses, in laid out condition, accurately adjoin the base of the structure.

In a preferred embodiment of an apparatus for carrying out the above method it is possible, at any rate when lowering a structure having a base, that each mattress roll is attached to the base of the structure because the roll is at either end suspended by two cables from a yoke resting on supports connected to the base, said yoke being connected to a drag line guided to the surface. At either roll end the suspension cable directed away from the base of the structure as seen from the roll axis can be released remotely, whereas the other cable directed towards the base is wound a number of times around the roll in the same sense as the mattress winding direction, the arrangement being such that after release of the former suspension cable the yoke can be lifted from its supports by means of the drag line and the roll with the mattress can be unrolled from the base.

Of the two suspension cables at either roll end each takes up one half of the weight of the mattress roll concentrated on the above-mentioned roll end. When releasing the suspension cable directed away from the base, which can be effected remotely by hydraulically opening a coupling, the roll comes to hang exclusively on the other cable, so that the roll falls on the bottom and thereby partly unwinds. By moving the drag line radially away from the lowered structure, for example with a tugboat, the yoke is lifted from the supports and the roll is unwound further.

To ensure that both during horizontal and vertical transport of the apparatus the mattress roll will not make swinging movements and hence each time strikes the base of the structure, it is possible, according to the invention, that each mattress roll in addition to being connected by the suspension cables, is also connected to the base of the structure to be lowered by a security cable which has a breaking strength such as to break after release of one suspension cable.

One embodiment of the invention will now be described, by way of example, with reference to the accompanying drawings showing the apparatus for providing a bottom protection.

Figure 1:
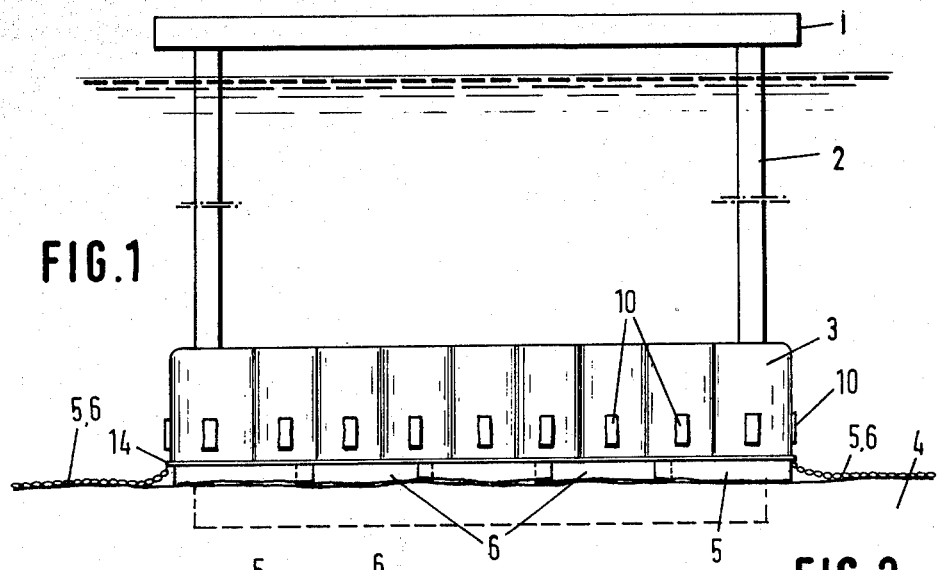
FIG. 1 shows schematically a platform resting on the seabottom and having a bottom protection provided around the base.

As shown in the drawings, particularly in FIG. 1, a lowered structure, for example a production platform, rest on the sea-bottom 4 via columns 2 and a base 3. In the embodiment described above the base 3 has a square cross-section and corrugated walls, the latter from considerations of strength.

Figure 2:
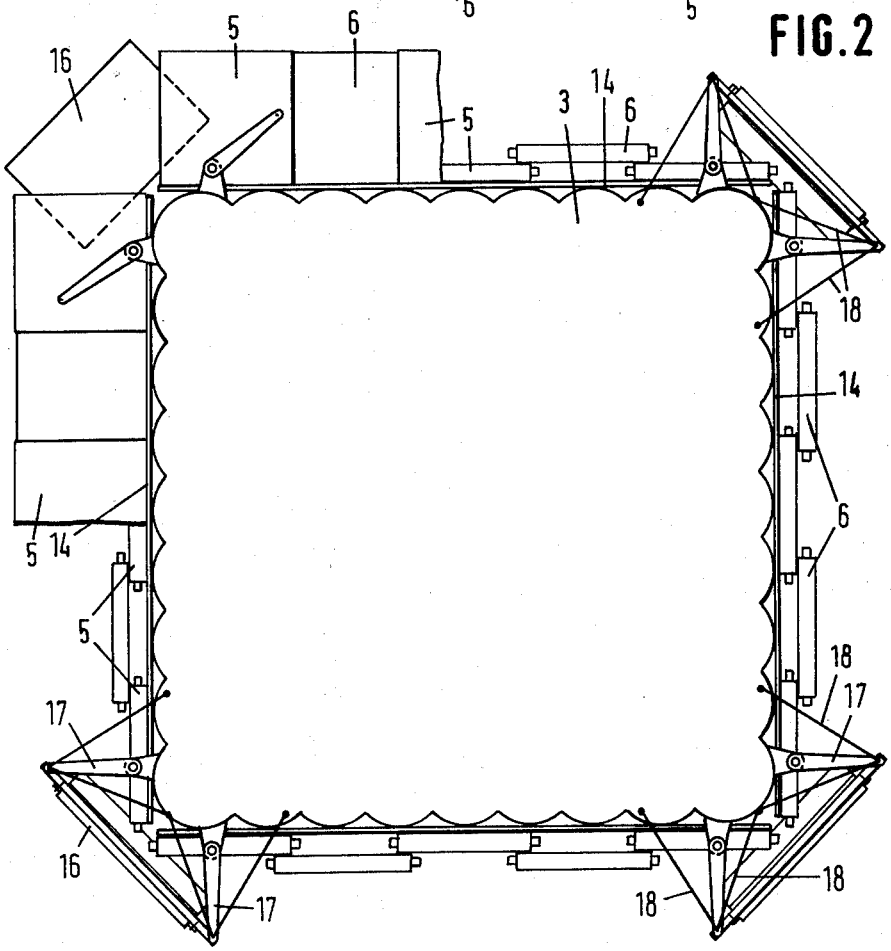
FIG. 2 is a plan view of the base surrounded by mattresses, a number of which is already unrolled

As appears from FIG. 2, mattress rolls 5 and 6 are positioned in overlapping relation around the base, rolls 5 only differing from rolls 6 in that rolls 5, so-called inner rolls, bear directly against the base, while rolls 6, the so-called outer rolls, bear with their ends against the inner rolls. After all rolls have been unrolled the mattresses coming from rolls 6 are each time the lowermost mattresses which are overlapped at the edges by the mattresses coming from rolls 5.

Figure 3:
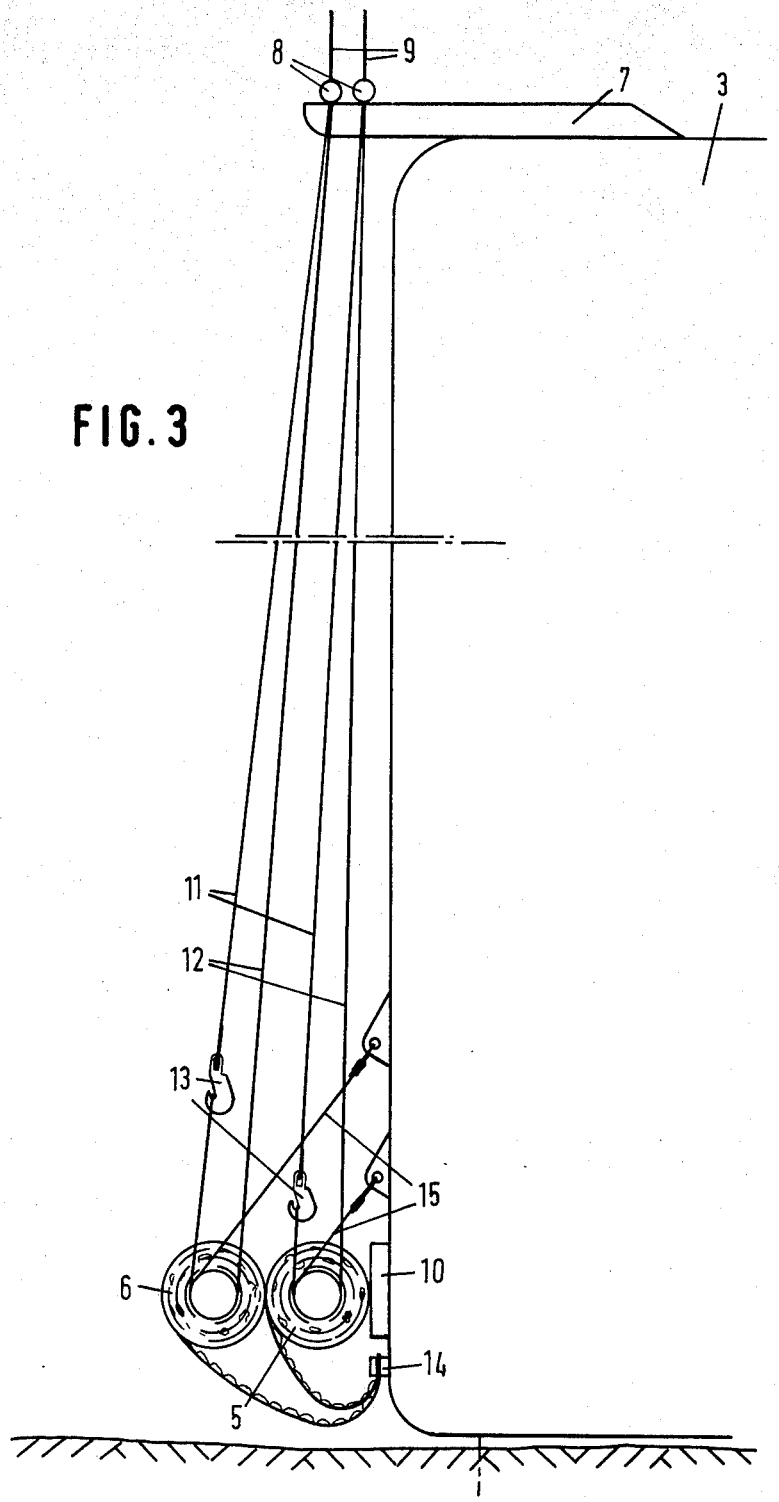
FIG. 3 shows schematically in side elevation the manner in which the rolls are suspended from the base.

FIG. 3 shows in general the way of suspension of inner rolls 5 and outer rolls 6. As can be seen in FIG. 3, the top of base 3 is provided with a number of supports 7 for each time two rods or yokes 8. The yokes can be attached to supports 7 with a security cable not shown to avoid unwanted slipping off the yokes, also referred to as equalizers. As will be described hereafter yokes 8 must be arranged to be lifted from the supports from the water surface by means of a drag line 9, the security cable then being broken.

Adjacent rolls 5 and 6 a buffer 10 made of wood can be arranged on base 3.

Each roll end is engaged by two suspension cables 11 and 12, of which cable 11 directed away from base 3 with respect to the roll axis is provided with a coupling means 13, which can be released remotely, that is, from the water surface, for example hydraulically. This coupling means does not form part of the invention and is therefore only shown schematically.

The free ends of mattress rolls 5 and 6 are connected to base 3 by means of an anchorage 14. Each roll 5, 6 is connected to the base by means of a security cable 15 of little strength compared to the suspension cables 11 and 12, this to prevent swaying of the rolls through waves or swell during transport.

As shown in FIG. 3, cable 11 to be released is wound over at least part of the circumference of roll 6 in counterclockwise direction thereabout, so opposite to the winding direction of the mattress on this roll. Cable 12, the so-called unwinding cable, however, is wound about the roll a number of times in the mattress winding direction, so in clockwise direction.

The operation of the apparatus is as follows.

After platform 1 with base 3 is lowered on the bottom it is possible, possibly first within a ring provided under the base, to fill the space formed by unevennesses of the bottom with mortar, so that the platform rests on a flat bottom. To position the bottom protection cables 11 of one or more outer rolls 6 are released by opening the coupling means 13 remotely. The force taken up by cables 11 is now fully shifted to security cable 15 which consequently breaks, so that roll 6 falls on the bottom beside base 3 and can partly unroll. Cable 12 does not prevent this in any respect, since the rolling direction thereof is equal to that of the mattress on the respective roll 6.

The next step is that at the surface the respective drag line 9 is pulled by means of a tugboat, so that yoke 8 is lifted from supports 7, and when the tugboat leaves the construction 1–4, roll 6 is radially unrolled from base 3 via drag line 9, yoke 8 and suspension cable 12. After all the outer rolls have unwound in this way the same procedure can be followed with the inner rolls, so that in the end the picture of the bottom protection shown on the left-hand top side of FIG. 2 is formed.

A problem which does not present itself in a base 3 which is circular in horizontal section must be solved, however, in the present case, in which corner zones must be covered. In this connection reference is made to FIG. 2. As is apparent from this Figure, for the corner zones use is made of a roll which extends along the angular point parallel to a diagonal. This roll 16 is suspended from a yoke by means of cables 11 and 12, the ends of which yoke are supported by jibs 17 projecting from base 3. The jibs 17 are suspended by anchoring cables 18. For the rest, the apparatus operates at the angular points in the same way as for rolls 5 and 6 along the sidewalls of base 3.

I claim:

1. An apparatus for forming a bottom protection around a structure in water, comprising, in combination:

at least one mattress having rolled up and unrolled states;

first coupling means operable for connecting one end of said mattress to said structure near its lowest part;

first and second cables;

support means connected near the top of said structure and operable for supporting said first and second cables;

a yoke detachably connected to said support and connected to said first and second cables;

a drag line connected to said yoke for detaching said yoke from said support;

second coupling means connecting said first cable to said mattress on the side away from said structure and operable for being detached remotely;

said second cable being wound around said mattress in the same sense as the winding of said mattress, whereby after the release of said first cable, said drag line can lift said yoke and move it away from said structure so that said second cable unrolls said mattress.

2. The apparatus as claimed in claim 1, further comprising a security cable connecting said mattress to a lower part of said structure and having a breaking strength less than the weight of said mattress, whereby said security cable breaks after said first cable is released.

* * * * *